United States Patent [19]

Paule

[11] Patent Number: 5,070,925

[45] Date of Patent: Dec. 10, 1991

[54] SECURITY SHUTTER SYSTEM

[75] Inventor: Helmut Paule, St. Petersburg, Fla.

[73] Assignee: Prime Marketing Group, Inc., St. Petersburg, Fla.

[21] Appl. No.: 535,144

[22] Filed: Jun. 8, 1990

[51] Int. Cl.[5] ..... E06B 9/08

[52] U.S. Cl. ..... 160/133; 160/23.1

[58] Field of Search ..... 160/133, 271, 23.1, 160/40, 236; 248/267; 292/DIG. 36

[56] References Cited

U.S. PATENT DOCUMENTS

| | | | |
|---|---|---|---|
| 77,088 | 4/1868 | Pellett . | |
| 1,463,647 | 7/1923 | Coss . | |
| 2,860,697 | 11/1958 | Ensign et al. . | |
| 2,894,572 | 7/1959 | Nelson . | |
| 2,906,323 | 9/1959 | Macy . | |
| 3,163,033 | 12/1964 | Boyles | 292/DIG. 36 |
| 3,451,463 | 6/1969 | Lyman . | |
| 3,494,073 | 2/1970 | Meddick . | |
| 3,672,492 | 6/1972 | Sherr . | |
| 3,732,913 | 5/1973 | Wrono . | |
| 3,739,832 | 6/1973 | Sivin . | |
| 3,842,892 | 10/1974 | Stieler . | |
| 4,018,259 | 4/1977 | Herms . | |
| 4,197,896 | 4/1980 | Reichstadt | 160/133 |
| 4,503,899 | 3/1985 | Forquer . | |
| 4,593,793 | 6/1986 | Salmon . | |
| 4,690,194 | 9/1987 | Seuster . | |
| 4,732,201 | 3/1988 | Dillitzer . | |
| 4,738,296 | 4/1988 | Hatch . | |
| 4,797,567 | 1/1989 | Pappas . | |

FOREIGN PATENT DOCUMENTS

| | | | |
|---|---|---|---|
| 2518356 | 11/1976 | Fed. Rep. of Germany | 160/133 |
| 2533617 | 3/1984 | France | 160/133 |
| 2584216 | 1/1987 | France | 160/133 |

*Primary Examiner*—Blair M. Johnson

*Attorney, Agent, or Firm*—Laurence R. Brown

[57] ABSTRACT

A rolling security shutter system is provided with improved structure for resolving security, alignment and tracking problems in rolling shutters employing an interconnected set of slats. Problems of insecure mounting and interfitting of housing assembly elements precisely enough that there is no misalignment or binding of the slats as the shutter is opened and closed are resolved inpart by integrally cast single element sideframes mounted by means of mounting bars interfitting into integrated guided slot brackets. The slats are guided into alignment with the tracks by means of frictionally inserted guides held by the sideplates. Connection of slats to the roller core by a flexible spring panel improves salt to track alignment and security against forced entry. Hood strengthening support structural mounts register housing members for better slot alignment and strength and ease of dismount. Improved spring clip slat reinforcement bar retainers assure slat rigidity and alignment. Security is improved with key controlled locking means encompassed in the lowermost slat to move two bars into registering apertures in both tracks.

6 Claims, 3 Drawing Sheets

SECURITY SHUTTER SYSTEM

TECHNICAL FIELD

This invention relates to security shutter systems and more particularly it relates to rolling shutter systems that raise a series of slats guided in a set of tracks upwardly to roll the slats on a roller.

BACKGROUND

While rolling shutter systems are well known in the art, there are a number of deficiencies that have not been available in competitively priced rolling shutter systems that are suitable for rather universal installation for window, doors and the like in a home. These deficiencies relate both to the functional performance of the shutters and the installation costs and convenience.

These competitively priced shutter systems have conventionally been assembled with storage housings made of sheet metal parts bolted or rivetted together for assembling in place on mounting wall surfaces. Some assemblies are difficult to mount in restricted spaces, and when assembled or secured in place are very difficult to originally align or to keep in alignment when operating over long periods of time. The very nature of the rolling shutter operating principle of guiding an assembly of slats in a set of spaced tracks makes these systems critical in alignment both in initial installation and for any changes of relative alignment caused by operating wear or stress. Thus if slats are not carefully kept parallel while guided into and moved back and forth in a set of tracks, exactly parallel to each other they bind and become inoperable. Flimsy or insecure mounts permit misalignments due to operational stresses after installation, even if they are carefully aligned and checked out initially. Furthermore the roller mechanisms and system assembly must be kept simple without sacrifice of stability, functional operation or ease of installation, seemingly inconsistent requirements not satisfactorily met in prior art systems.

Specific problems encountered in prior art systems include, for example: (1) deficient mounting strength to hold heavy overhead rollers in place for long operating periods while encountering frequent movement under load conditions by operators who are not motivated to care for the installation or follow preferred operational rules; (2) critical operating conditions that require precise alignment and freedom of movement over relatively long distances under conditions that cannot be precisely journalled or lubricated; (3) subjection to weather conditions such as wind and rain that can disturb operation and cause erosion; (4) attempts to forcibly move parts for unauthorized entry or to overcome operating deficiencies; and (5) excessive equipment and installation costs. It is therefore an objective of this invention to provide an improved rolling security shutter system that overcomes these problems of the prior art.

Other objects, features and advantages of the invention will be found throughout the following description, drawings and claims.

DISCLOSURE OF THE INVENTION

The rolling security shutter system afforded by this invention incorporates a variety of improved features interacting to produce optimum cooperation of the moving parts and simplified installation assuring initial alignment and sturdy long life trouble free operation.

Some of the interacting features include sturdy side frame mounts with improved wall mounting features for either wall or ceiling mount and providing support for a rigidly affixed demountable housing hood and track alignment fittings, roller mounting features for better slat alignment in tracks and more secure closure features against unauthorized or forced entry attempts and wind induced chatter. Improved quick mount bracket inserts provide for long life trouble free reinforcement bars and operational alignment of slats and tracks with simplified assembly and installation advantages. Security locking means is also provided in a rolling security shutter system affording improved performance to overcome the hereinbefore mentioned deficiencies of the prior art.

BRIEF DESCRIPTION OF THE DRAWINGS

In the accompanying drawing, wherein like reference characters represent related features throughout the several views.

Figure 1:
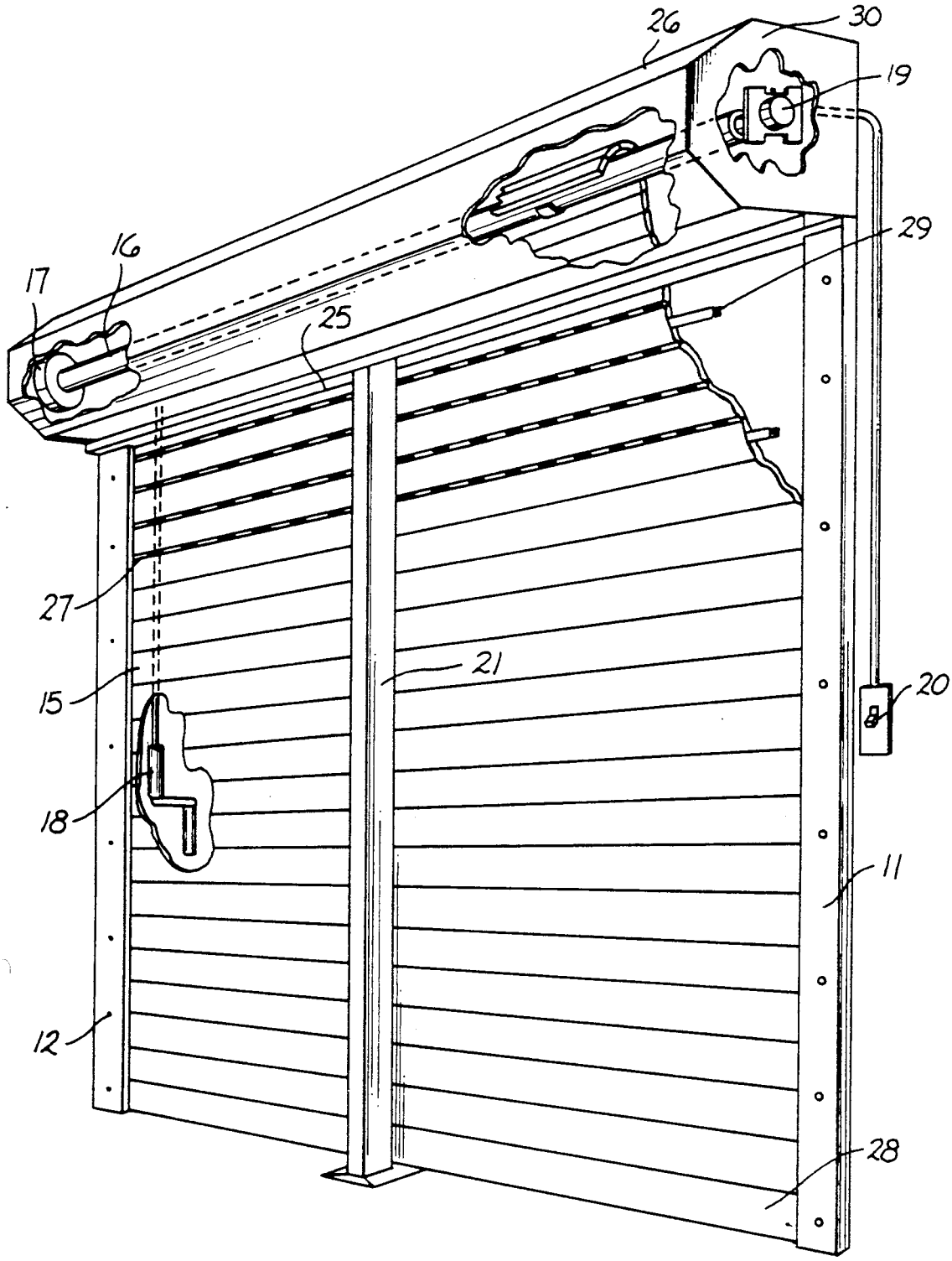
FIG. 1 is a perspective sketch, partly broken away of a rolling security shutter system incorporating the various features afforded by the present invention.

The shutter system of FIG. 1, is installed upon an inside or outside wall for covering an opening such as a window or door, not shown. A pair of tracks 11, 12 channel a sequence of interconnected slats 15 for movement between the illustrated closed position with the slats covering the door or window and an open position with the slats stored upon a roller 16 as shown by the broken away view 22. The roller assembly rolls up and stores the slats by means of either a manually operated mechanism 17 with handle 18 or a motor powered mechanism 19 operated by switch 20.

A center post or purlin 21 may be used for support of the overhead roller assembly for wider spans at a header 25 longitudinally disposed over the length of the mount under the hood 26, and remainder of the housing assembly. The slats may be of the ventilated type illustrated at 27 or closed. A bottommost slat 28 may be specially constructed as later described in more detail. H-shaped metallic reinforcement bars may be extended through the slats in the manner indicated at 29.

Figure 2:
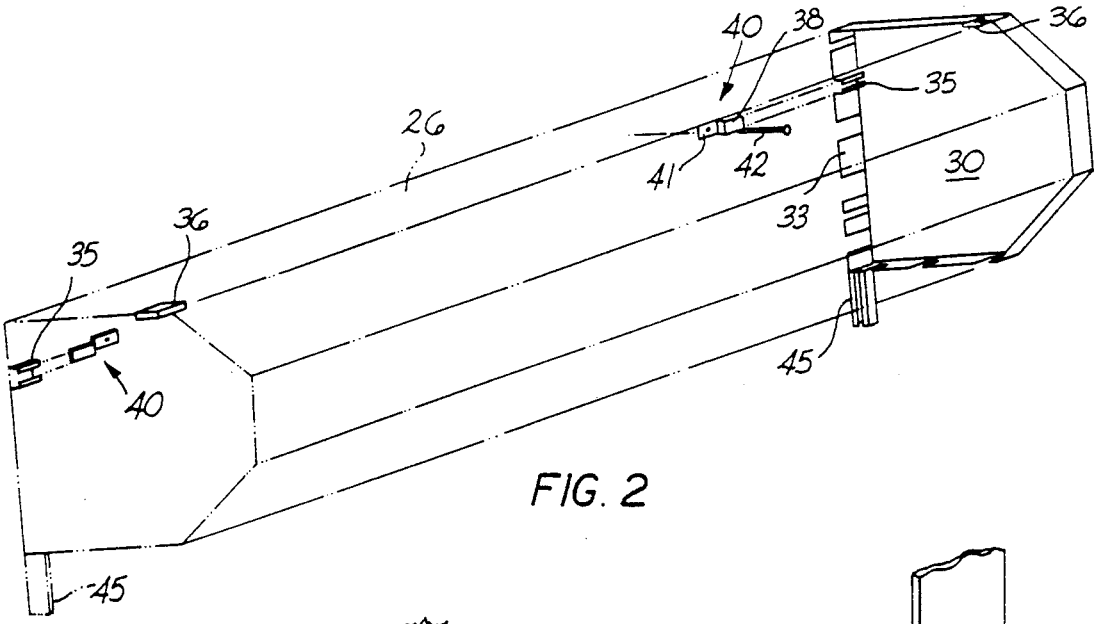
FIG. 2 is a sketch of a shutter installation, partly in phantom, featuring side frame mounting structure, as more particularly set forth in the enlarged fragmental views of FIGS. 2A and 2B respectively showing side frame mounting slot structure and slat to track guide bracket retaining structure.
Figure 2B:
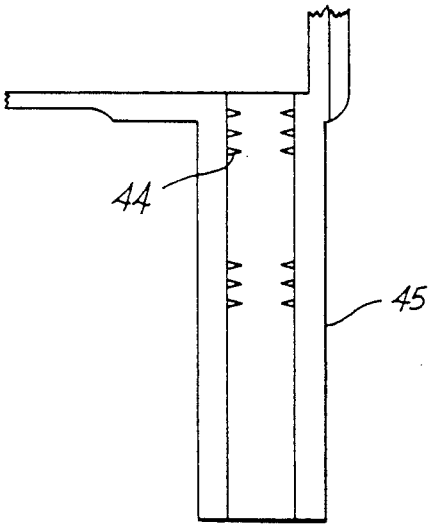
Figure 2A:
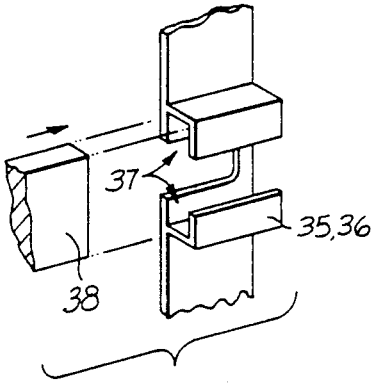

The roller assembly housing is mounted on the wall surface and supported by means of two side frames 30, in a manner more particularly illustrated in FIG. 2. In the prior art such end frames were basically made of thin sheet metal and were attached by a nail or screw through an aperture in a back rim flap 33. This location was difficult to reach and mount firmly, and the sheet tended to bend so that critical alignment could change with operating stresses. Thus, the side frames in accordance with this invention are die cast load bearing units incorporating a plurality of integrally cast-in mounting bracket slots, such as 35 for back wall mounting and 36 for ceiling mounting. These bracket slots 35, 36, as shown in more detail in FIG. 2A, receive in a pair of spaced apart u-shaped slots 37 a rectangular end 38 of a Z shaped bar fastener bracket 40 in a sliding motion parallel to an axis of the housing assembly. The Z-bar 40 has substantially parallel planar offset surfaces 38, 41 serving as a clamping arm 38 and a mounting arm 41, which is apertured to receive a nail or screw fastener 42.

Figure 3:
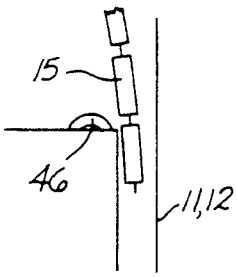
FIGS. 3 and 3A are respectively side view and end view sketches of the guidance track at a slat entry position.
Figure 3A:
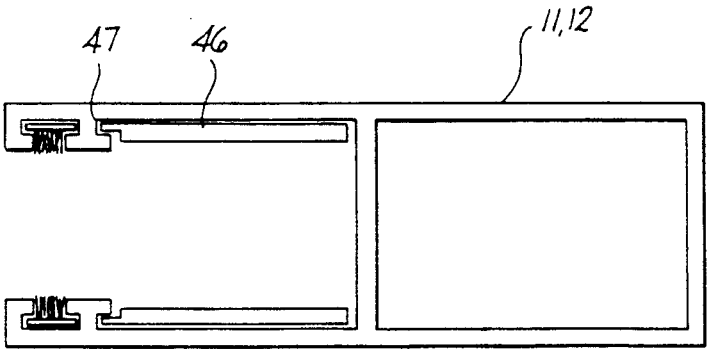

The sideframes 30 further have an integrally cast vertically disposed bifurcated leg structure 45 extending downwardly from the roller assembly, and having inwardly directed serration 44 on at least one leg for receiving a slat guide member 46 in locked position for engaging the slats and directing them into the tracks 11, 12 in precise alignment. The guide member 46 is preferably a plastic self lubricating member of a substance such as "Nylon" which is frictionally inserted into the serration 44 with enough force to provide a strong grip for withstanding any frictional forces encountered in operation with slats gliding thereover in the path between the roller 16 and the open upper end of the track 11, 12. The positioning of the slats 15 into the track over the guide member 46 is shown in FIG. 3. FIG. 3A shows the guide 46 as registered in a groove 47 of the track 11, 12.

Figure 4A:
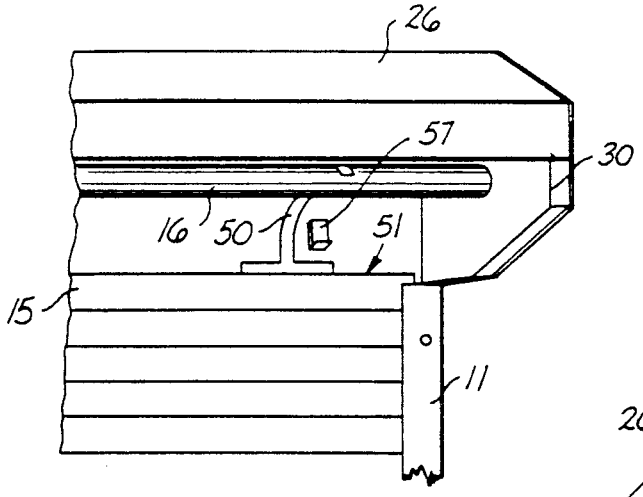
FIGS. 4 and 4A are respectively a schematic end view of a shutter to roller mount feature of the invention, and front assembly fragmental sketch partly broken away.
Figure 4:
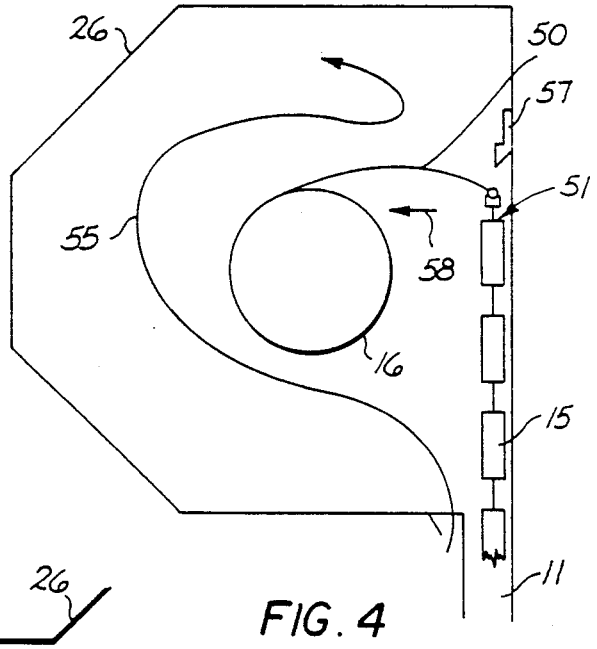

As may be seen from FIGS. 4 and 4A, the slats 15 are specially hung on the roller 16 by means of a flexible spring panel 50 of critical construction. Thus, the inner end 51 of the set of interconnected slats 15 to be rolled on the core 16 of the roller has such length as to extend the set of slats in the closed shutter position in alignment with the pair of tracks. Also the flexible spring panel has such flexibility that it is initially rolled onto the roller core 16 before the slats when they are moved away from the closed shutter position.

This feature provides better alignment and less chance for a slat to tilt or bind in the tracks, and additionally eliminates the tendency in conventional prior art shutters to chatter and whistle in the presence of wind (55) that enters the housing when the shutter is closed. Furthermore it permits better security by provision of the security catch or stop 57, which restricts vertical movement of the interconnected slats in the tracks away from the closed shutter position, except by means of rolling the flexible spring panel 50 onto the roller core 16 in a pathway moving the inner end of the interconnected slats away from the security stop 51 in the direction of arrow 58.

Accordingly, if either forced entry is attempted by movement of the slats 15 upwardly or an attempt is made to raise the slats without the use of the roller mechanism, that will be prevented by the security stops 57.

Figure 5:
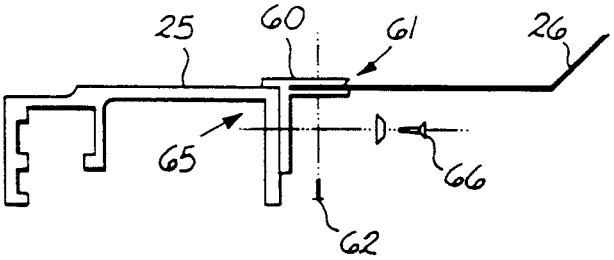
FIG. 5 is an end view fragmental sketch of a hood mounting feature of the invention, and FIG. 6 sets forth an improved reinforcement bar mounting feature afforded by the invention.

The housing assembly hood member 26 is generally of thin sheet metal. It needs to be removably mounted for access to the roller mechanism, and yet it needs to be firmly and neatly in place when in use as a decorative part of the housing assembly. Accordingly improved mounting means is afforded by this invention as shown in FIG. 5. The metal bracket 60 has a slot 61 for receiving the edge of the hood panel 26, wherein it may be screwed or riveted (62). This bracket 60 registers in shape with the header 25 for firm support in an interengaging surface along the length of the hood 26 at 65, so that it may be screwed removably in place (66) for easy assembly and disassembly.

Figure 6:
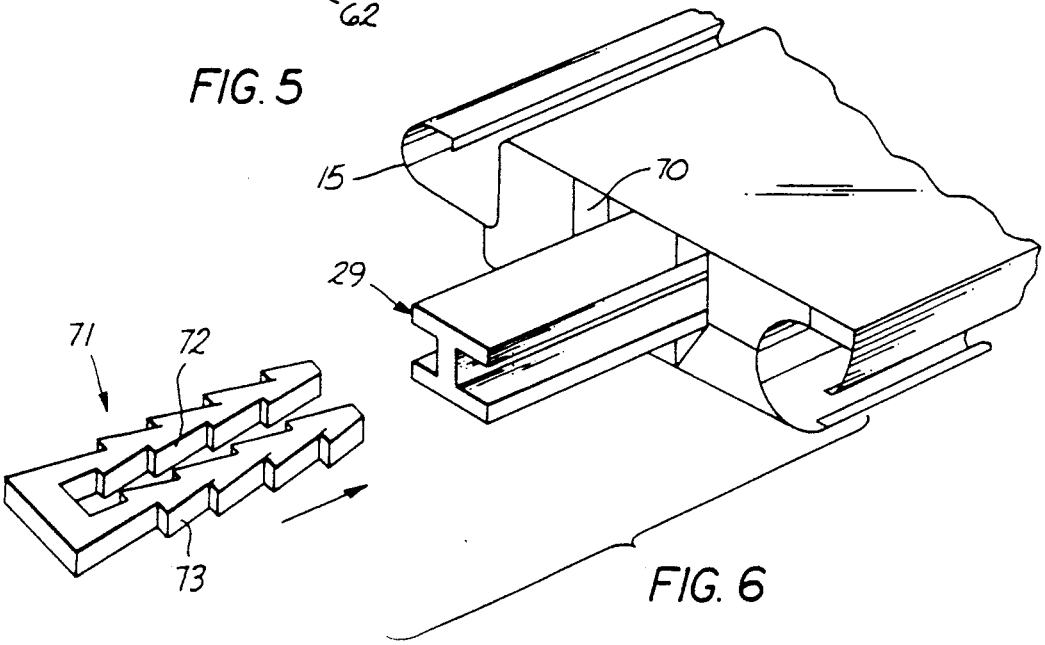

As shown in FIG. 6, the H-shaped reinforcement bars 29 extend through longitudinally extending passageways along the length of the slats between the two tracks 11, 12 which terminate in an apertured opening 70 at each end of the slats 15. These reinforcing bars have been difficult to assemble, and need to be optional features for any particular installation. In accordance with this invention, a serrated plastic spring clip 71 is made to fit within the H channels to overlap and engage the H crossbar member with the inwardly directed serration 72 and lock the metal reinforcement bar into place in the aperture 70 by means of the outwardly directed serration 73. This clip is made of a plastic material that will not erode with the weather or interact electrochemically with the generally aluminum H-bar reinforcing member 29 to assure long trouble free life, in spite of its simplicity and convenience.

It is evident from the foregoing that this invention has provided an improved rolling security shutter system resolving prior art deficiencies. Accordingly those novel features defining the spirit and nature of this invention are set forth with particularlity in the following claims.

I claim:

1. A rolling security shutter system, comprising in combination, a pair of tracks for guiding a plurality of interconnected slats between open and closed shutter positions, a set of interconnected slats for riding in the tracks to provide a closed shutter, a roller assembly for rolling up and storing said slats when moved between said closed and open shutter positions, and a housing assembly for mounting said roller assembly in place on a mounting surface by means of a pair of side frames to move the interconnected slats in alignment for riding in said tracks, wherein said sideframes comprise load bearing units incorporating a plurality of integrally mounting bracket slots defining a receptacle with four walls each for receiving in a sliding relationship a clamping arm of a Z shaped bar fastener bracket thereinto, and a plurality of said Z shaped brackets mating into said receptacles and affixing the housing assembly to a mounting surface.

2. The shutter system defined in claim 1 wherein the mounting bracket slots further comprise a pair of spaced apart u-shaped slots adapted to receive said clamping arm thereinto by sliding motion parallel to an axis of the housing assembly.

3. The shutter system defined in claim 1 wherein the plurality of mounting bracket slots includes slots positioned on upper and rear sides of said sideframes for affixing to a side wall and a ceiling respectively the fastener bracket.

4. A shutter system as defined in claim 1 further comprising, slats having longitudinally extending passageways extending between the two tracks for receiving a reinforcement bar thereinto and terminating in an apertured opening at each end of the slats, reinforcement bar means for the slats comprising a metallic bar substantially H shaped in cross section with a crossbar member positioned to extend through the openings at the two ends of the slats, and serrated spring clips mating into channels formed by the H shaped cross section for overlapping and engaging the crossbar member and the slats about the apertured opening to lock the metal bars in place in the respective slats.

5. A rolling security shutter system, comprising in combination, a pair of tacks for guiding a plurality of interconnected slats between open and closed shutter positions, a set of interconnected slats for riding in the tracks to provide a closed shutter, a roller assembly for rolling up and storing said slats when moved between said closed and open shutter positions, and a housing assembly for mounting said roller assembly in place on a mounting surface by means of a pair of side frames to move the interconnected slats in alignment for riding in said tracks, wherein said sideframes further comprise a vertically disposed bifurcated leg structure extending downwardly from the roller assembly having inwardly directed serration on a least one leg for receiving a guide in locked position for engaging the slats and directing then into said tracks in alignment therewith.

6. A rolling security shutter system, comprising in combination, a pair of tracks for guiding a plurality of interconnected slats between open and closed shutter positions, a set of interconnected elongated slats for riding in the tracks to provide a closed shutter, a roller assembly for rolling up and storing said slats on a roller core when moved between said closed and open shutter positions, a housing assembly for mounting said roller assembly in place on a mounting surface by means of side frames and support elements to move the interconnected slats in alignment for riding in said tracks, reinforcement bar means for the slats comprising a metallic bar substantially H shaped in cross section positioned to extend through a recess along the length of said slats, and serrated spring clips positioned into channels formed by the H shaped cross section to engage the reinforcement bar means and the slats for locking the metal bars in place in the respective slats.

* * * * *